US012768540B2

(12) United States Patent
Paller

(10) Patent No.: US 12,768,540 B2
(45) Date of Patent: Oct. 20, 2026

(54) OVEN APPLIANCE WITH FLAME PROVING

(71) Applicant: Haier US Appliance Solutions, Inc., Wilmington, DE (US)

(72) Inventor: Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 313 days.

(21) Appl. No.: 18/415,899

(22) Filed: Jan. 18, 2024

(65) Prior Publication Data

US 2025/0237387 A1 Jul. 24, 2025

(51) Int. Cl.
*F24C 3/12* (2006.01)
*F24C 3/08* (2006.01)

(52) U.S. Cl.
CPC ..... *F24C 3/128* (2013.01); *F24C 3/087* (2013.01)

(58) Field of Classification Search
CPC ..... F24C 3/128; F24C 3/087
See application file for complete search history.

(56) References Cited

U.S. PATENT DOCUMENTS 10,247,418 B2 4/2019 Bianchi et al.
2014/0212821 A1 7/2014 Banu et al.

FOREIGN PATENT DOCUMENTS

EP 3985306 A1 4/2022
JP 6494312 B2 4/2019
JP 2023100524 A * 7/2023
WO WO-2019239438 A1 * 12/2019 ..... F23N 5/102
WO WO-2023175218 A1 * 9/2023 ..... F24C 3/128

OTHER PUBLICATIONS

"Thermocouple—Types, Construction, Working and Applications", Electrical Technology, https://www.electricaltechnology.org/2022/04/thermocouple-types-construction-working-applications.html, accessed Jan. 17, 2024, 23 pages.
Potter, David, "Measuring Temperature with Thermocouples—a Tutorial", National Instruments, The Software is the Instrument, Application Note 043, published Nov. 1996, 16 pages.

* cited by examiner

*Primary Examiner* — Ngoc T Nguyen
(74) *Attorney, Agent, or Firm* — Dority & Manning, P.A.

(57) ABSTRACT

An oven appliance includes a cabinet and a chamber defined within the cabinet for receipt of food items for cooking. A gas burner is positioned in the cabinet, and a temperature probe is positioned proximate the gas burner. The temperature probe is a dual junction probe that includes a pair of temperature junctions. The oven appliance further includes a controller positioned within the cabinet. The controller is in data communication with the temperature probe, and a voltage difference measured by the temperature probe is indicative of flames from the gas burner.

19 Claims, 4 Drawing Sheets

OVEN APPLIANCE WITH FLAME PROVING

FIELD OF THE INVENTION

The subject matter of the present disclosure relates generally to an oven appliance, such as a full-size gas oven appliance or gas range appliance, and more specifically to systems for flame proving in a gas oven appliance.

BACKGROUND OF THE INVENTION

Oven appliances generally include a cabinet that defines a cooking chamber for cooking food items therein, such as by baking or broiling the food items. To heat the cooking chamber for cooking, oven appliances include one or more heating elements positioned at a top portion, a bottom portion, or both the top portion and the bottom portion of the cooking chamber. Some oven appliances also include a convection heating element and fan for convection cooking cycles. The heating element or elements may be used for various cycles of the oven appliance, such as a preheat cycle, a cooking cycle, or a self-cleaning cycle.

Residential gas oven burner system have safety requirements regarding flame proving. Typical flame proving methods use flame rectification sensors that feed a signal into a control board that give the proper indication that the burner flame has been lit or not, however, flame rectification sensors and accompanying circuitry are complex, expensive, and prone to being contaminated. Additionally, visual systems for flame proving are easily soiled with food in an oven and are prone to nuisance failures. Traditional thermocouple systems can be too slow to respond in an oven that can run as high as 800 degrees Fahrenheit.

Accordingly, an oven appliance with a simplified, cheaper, and faster flame proving system would be desirable.

BRIEF DESCRIPTION OF THE INVENTION

Aspects and advantages of the invention will be set forth in part in the following description, may be apparent from the description, or may be learned through practice of the invention.

In one example embodiment, an oven appliance is provided. The oven appliance includes a cabinet and a chamber within the cabinet for receipt of food items for cooking. The chamber is delineated by a plurality of walls including a bottom wall, a left side wall, and a right side wall. A gas burner is positioned within the chamber, and a temperature probe positioned proximate the gas burner. The temperature probe is a dual junction probe that includes a pair of temperature junctions. The oven appliance further includes a controller positioned within the cabinet. The controller is in data communication with the temperature probe, and a voltage difference measured by the temperature probe is indicative of flames from the gas burner.

In another example embodiment, an oven appliance is provided. The oven appliance includes a cabinet and a chamber defined within the cabinet for receipt of food items for cooking. A gas burner is positioned in the cabinet, and a temperature probe positioned proximate the gas burner. The temperature probe is a dual junction probe that includes a pair of temperature junctions. The oven appliance further includes a controller positioned within the cabinet. The controller is in data communication with the temperature probe, and a voltage difference measured by the temperature probe is indicative of flames from the gas burner.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
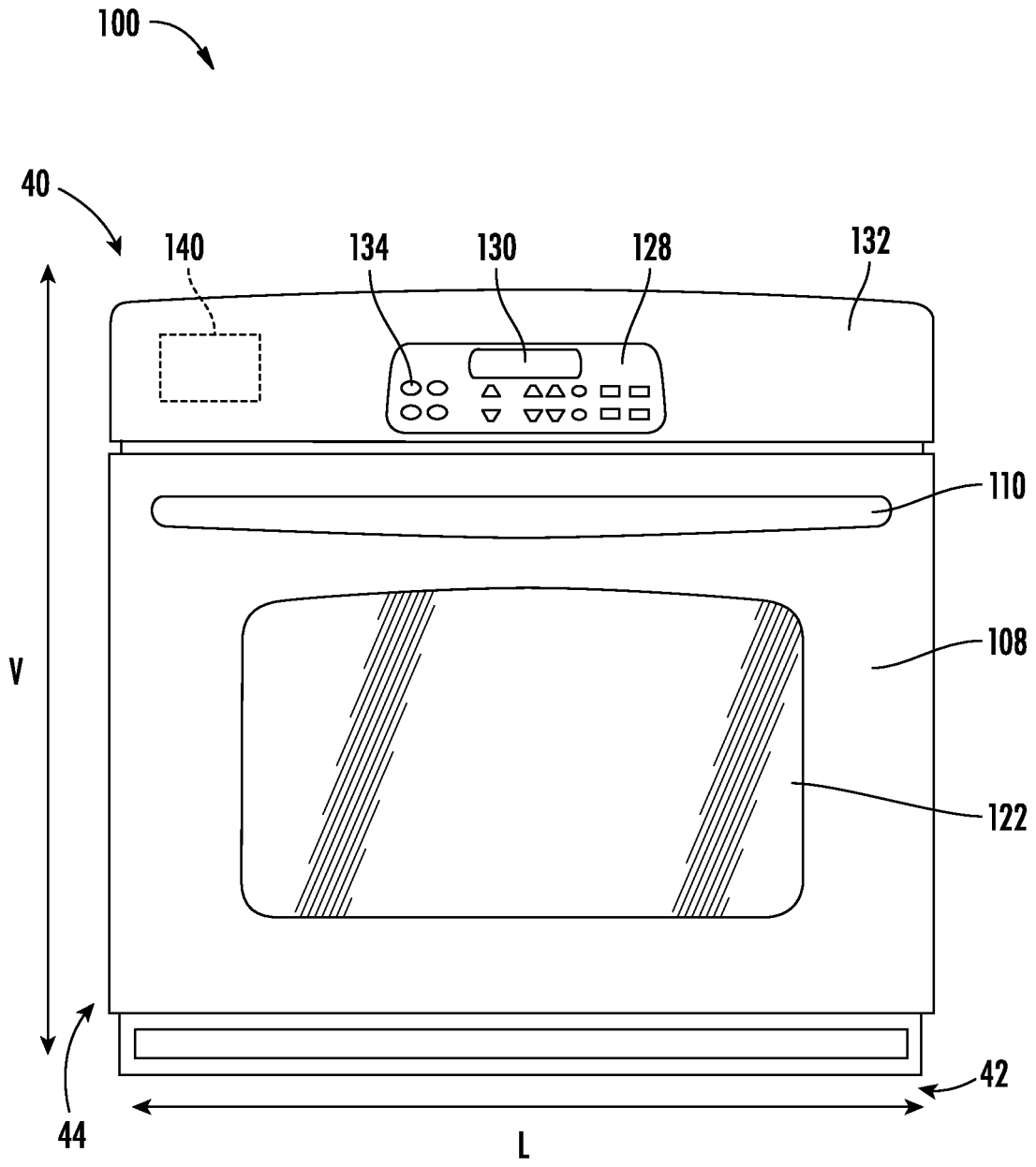
FIG. 1 provides a front view of an example oven appliance according to one or more embodiments of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. In the context of an angle or direction, such terms include values within ten degrees of the stated direction. For example, "generally vertical" includes directions within ten degrees of vertical in any direction, e.g., clockwise or counter-clockwise.

Figure 2:
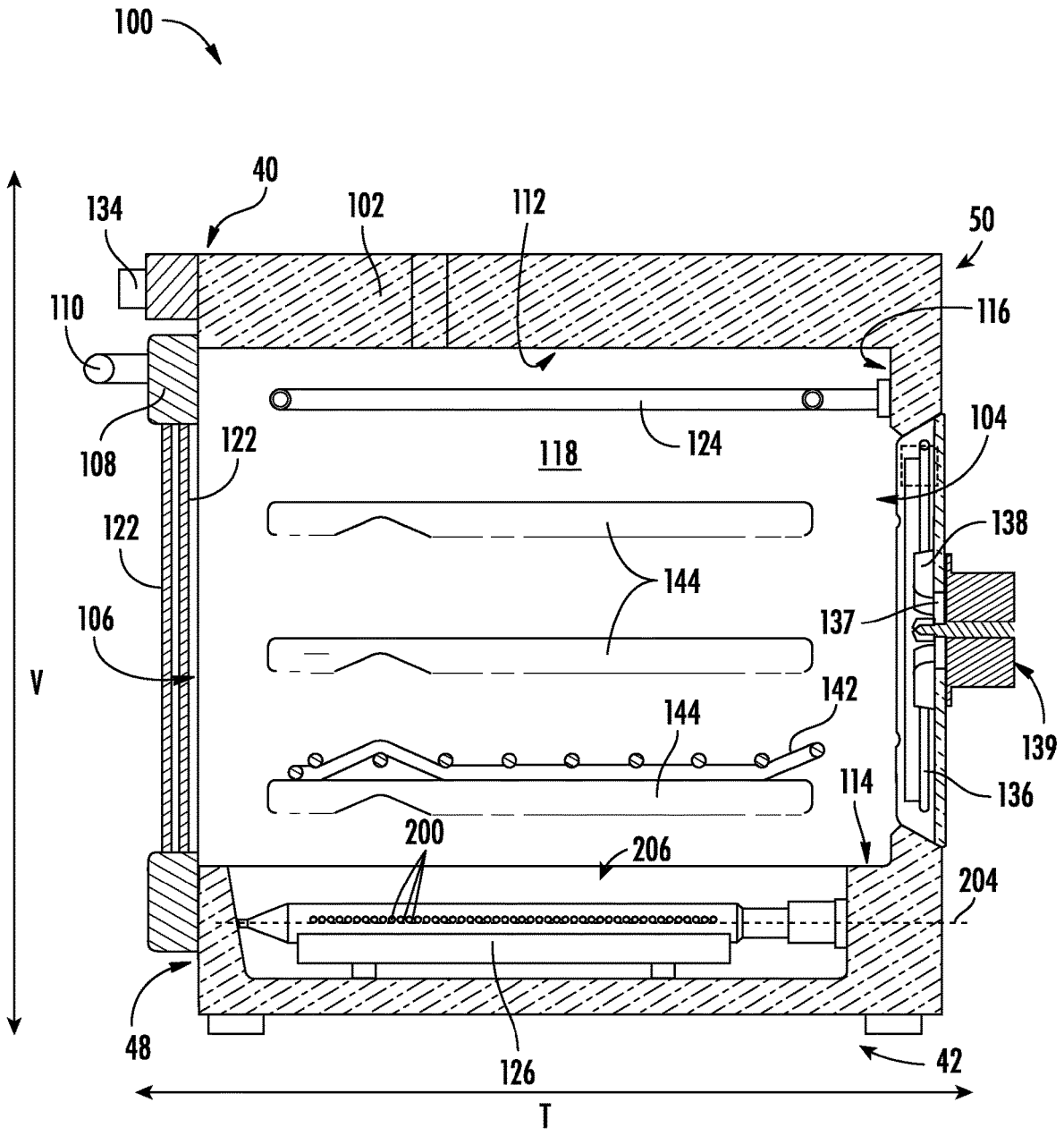
FIG. 2 provides a side section view of the oven appliance of FIG. 1.

FIGS. 1 and 2 illustrate an oven appliance 100 according to an example embodiment of the present subject matter. Oven appliance 100 includes an insulated cabinet 102 which defines a vertical direction V, a lateral direction L, and a transverse direction T. The vertical, lateral, and transverse directions V, L, and T are mutually perpendicular and form an orthogonal direction system. Cabinet 102 extends between a top portion 40 and a bottom portion 42 along the vertical direction V. Cabinet 102 extends between a left side 44 and a right side 46 along the lateral direction L and between a front portion 48 and a back portion 50 along the transverse direction T.

Still referring to FIGS. 1 and 2, for this example embodiment, oven appliance 100 includes an insulated cabinet 102 with an interior cooking chamber 104 defined by a top wall 112, a floor or bottom wall 114, a back wall 116, and a pair of opposing side walls 118. Cooking chamber 104 is configured for the receipt of one or more food items to be cooked. Oven appliance 100 includes a door 108 pivotally mounted to cabinet 102 at the opening 106 of cabinet 102 to permit selective access to cooking chamber 104 through opening 106. A handle 110 is mounted to door 108 and assists a user with opening and closing door 108. For example, a user can pull on handle 110 to open or close door 108 and access cooking chamber 104.

Oven appliance 100 can include a seal (not shown) between door 108 and cabinet 102 that assists with maintaining heat and cooking vapors within cooking chamber 104 when door 108 is closed as shown in FIGS. 1 and 2. Multiple parallel glass panes 122 provide for viewing the contents of cooking chamber 104 when door 108 is closed and assist with insulating cooking chamber 104. A baking rack 142 is positioned in cooking chamber 104 for the receipt of food items or utensils containing food items. Baking rack 142 is slidably received onto embossed ribs or sliding rails 144 such that rack 142 may be conveniently moved into and out of cooking chamber 104 when door 108 is open.

One or more heating elements may be included at the top, bottom, or both of cooking chamber 104 to provide heat to cooking chamber 104 for cooking. Such heating element(s) may be gas, electric, microwave, or a combination thereof. For example, in the embodiment shown in FIG. 2, oven appliance 100 includes a top heating element 124 which, in the illustrated example embodiment is an electric resistance heating element 124, and a bake heating element or bottom heating element 126, which, in the illustrated example embodiment of FIG. 2 is a gas burner 126. In the present example embodiment, gas burner 126 is positioned adjacent to and below bottom wall 114. For example, gas burner 126 may be positioned within a combustion chamber 206. In general, combustion chamber 206 may be an open space beneath bottom wall 114 where gas burner 126 is disposed such that gas burner 126 may be in thermal communication with cooking chamber 104.

In the illustrated example embodiment, oven appliance 100 also has a convection heating element 136 and convection fan 138 positioned adjacent back wall 116 of cooking chamber 104. Convection fan 138 is powered by a convection fan motor 139. Further, convection fan 138 can be a variable speed fan-meaning the speed of fan 138 may be controlled or set anywhere between and including, e.g., zero and one hundred percent (0%-100%). In certain embodiments, oven appliance 100 may also include a bidirectional triode thyristor (not shown), i.e., a triode for alternating current (TRIAC), to regulate the operation of convection fan 138 such that the speed of fan 138 may be adjusted during operation of oven appliance 100. The speed of convection fan 138 can be determined by controller 140. In addition, a sensor 137 such as, e.g., a rotary encoder, a Hall effect sensor, or the like, may be included at the base of fan 138, for example, between fan 138 and motor 139 as shown in the example embodiment of FIG. 2, to sense the speed of fan 138. The speed of fan 138 may be measured in, e.g., revolutions per minute ("RPM"). In some embodiments, the convection fan 138 may be configured to rotate in two directions, e.g., a first direction of rotation and a second direction of rotation opposing the first direction of rotation. For example, in some embodiments, reversing the direction of rotation, e.g., from the first direction to the second direction or vice versa, may still direct air from the back of the cavity. As another example, in some embodiments reversing the direction results in air being directed from the top and/or sides of the cavity rather than the back of the cavity. Additionally, the convection heating features are optional and are shown and described herein solely by way of example. In additional embodiments, the oven appliance 100 may include different convection heating features or may not include convection heating features at all.

Oven appliance 100 may generally include a user interface 128 having a display 130 positioned on an interface panel 132 and having a variety of controls 134. Interface 128 allows the user to select various options for the operation of oven 100 including, e.g., various cooking and cleaning cycles. Operation of oven appliance 100 can be regulated by a controller 140 that is operatively coupled to, i.e., in communication with, user interface 128, heating elements 124, 126, and other components of oven 100 as will be further described.

Figure 3:
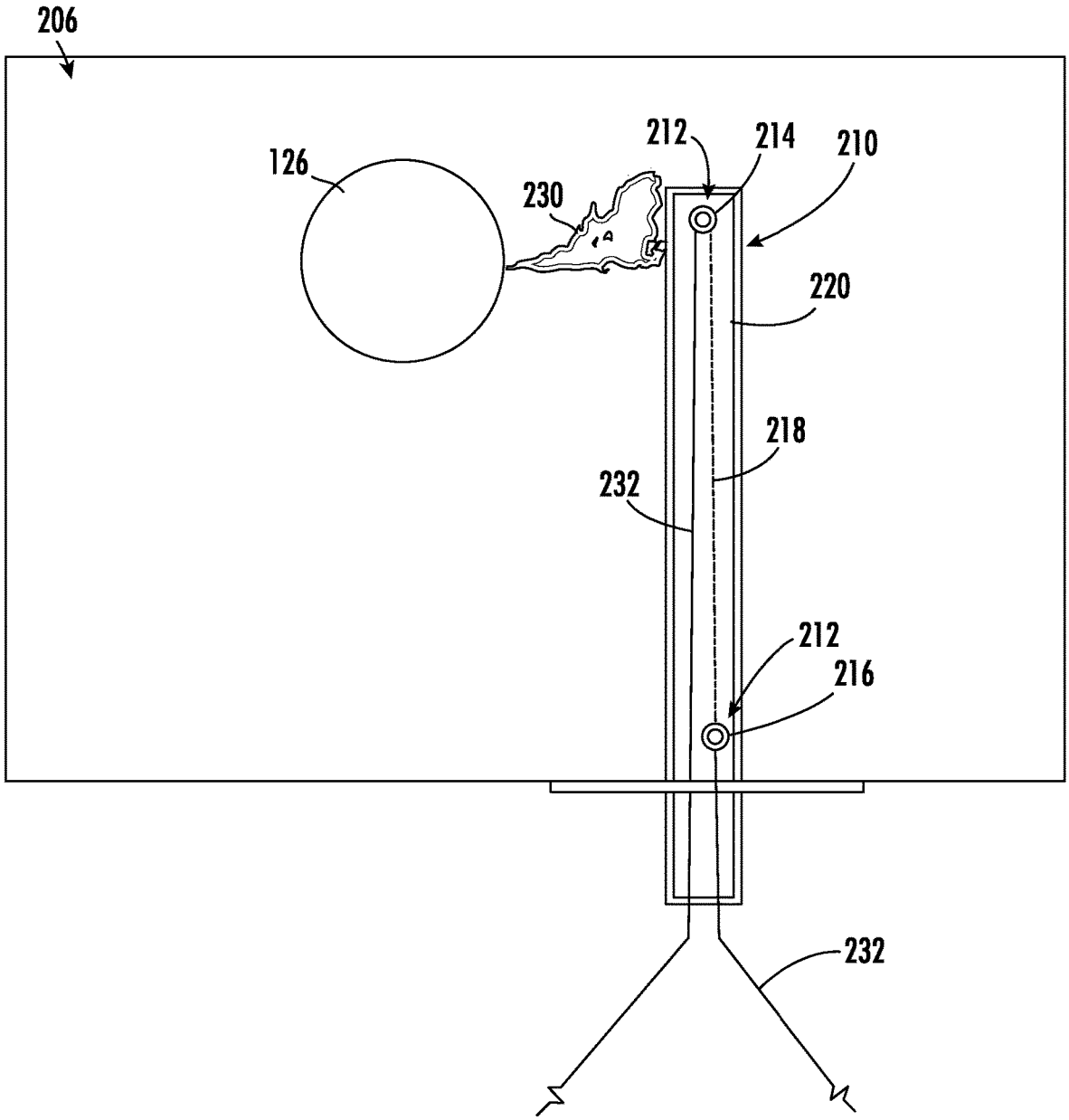
FIG. 3 provides a schematic view of an example probe of the oven appliance of FIG. 1.

For example, in response to user manipulation of the user interface 128, controller 140 can operate the heating element(s). Controller 140 can receive measurements from one or more temperature sensors, such as a temperature probe 210 (FIG. 3). More specifically, temperature probe 210 may be positioned proximate gas burner 126 as will be described in further detail hereinbelow. Controller 140 may also provide information such as a status indicator, e.g., a temperature indication or a flame presence indication, to the user with display 130. Controller 140 may also be provided with other features as will be further described herein.

Controller 140 may include a memory and one or more processing devices such as microprocessors, CPUs, or the like, such as general or special purpose microprocessors operable to execute programming instructions or micro-control code associated with operation of oven appliance 100. The memory may represent random access memory such as DRAM or read only memory such as ROM or FLASH. In one embodiment, the processor executes programming instructions stored in memory. The memory may be a separate component from the processor or may be included onboard within the processor. The memory can store information accessible by the processor(s), including instructions that can be executed by processor(s). For example, the instructions can be software or any set of instructions that when executed by the processor(s), cause the processor(s) to perform operations. For the embodiment depicted, the instructions may include a software package configured to operate the system, e.g., to execute example methods of operating the oven appliance 100. Controller 140 may also be or include the capabilities of either a proportional (P), proportional-integral (PI), or proportional-integral-derivative (PID) control for feedback-based control implemented with, e.g., temperature feedback from one or more sensors such as temperature sensors and/or probes, etc.

Controller 140 may be positioned in a variety of locations throughout oven appliance 100. In the illustrated embodiment, controller 140 is located next to user interface 128 within interface panel 132. In other embodiments, controller 140 may be located under or next to the user interface 128, otherwise within interface panel 132, or at any other appropriate location with respect to oven appliance 100. Generally, controller 140 may be positioned within cabinet 102. In the embodiment illustrated in FIG. 1, input/output ("I/O") signals are routed between controller 140 and various operational components of oven appliance 100 such as heating elements 124, 126, 136, convection fan 138, controls 134, display 130, alarms, and/or other components as may be provided. In one embodiment, user interface 128 may represent a general purpose I/O ("GPIO") device or functional block.

Although shown with touch type controls 134 in FIG. 1, it should be understood that controls 134 and the configuration of oven appliance 100 shown in FIG. 1 is provided by way of example only. More specifically, user interface 128 may include various input components, such as one or more of a variety of electrical, mechanical, or electro-mechanical input devices including rotary dials, push buttons, and touch pads, e.g., such as a knob as illustrated in FIG. 2, among other possible examples and combinations. User interface 128 may include other display components, such as a digital or analog display device designed to provide operational feedback to a user. User interface 128 may be in communication with controller 140 via one or more signal lines or shared communication busses.

While oven 100 is shown as a wall oven, the present invention could also be used with other cooking appliances such as, e.g., a stand-alone oven, an oven with a stove-top, or other configurations of such ovens. Numerous variations in the oven configuration are possible within the scope of the present subject matter. For example, variations in the type and/or layout of the controls 134, as mentioned above, are possible. As another example, the oven appliance 100 may include multiple doors 108 instead of or in addition to the single door 108 illustrated. Such examples include a dual cavity oven, a French door oven, and others. The examples described herein are provided by way of illustration only and without limitation.

Referring specifically to FIG. 2, it may be seen that the gas burner 126 defines a generally cylindrical shape with a longitudinal axis 204 extending therethrough. The gas burner 126 also includes a plurality of ports 200 defined therein, e.g., in one or more linear arrays on one or more sides of the gas burner 126. As will be recognized and understood by those of ordinary skill in the art, the ports 200 orient and direct combustion products, e.g., flames and heated gases, from the gas burner 126, e.g., from within combustion chamber 206 to or towards the cooking chamber 104. In the example embodiment illustrated in FIG. 2, the gas burner 126 is oriented generally along the transverse direction T, e.g., the longitudinal axis 204 of the gas burner 126 is parallel to or within ten degrees of the transverse direction T.

Referring now to FIG. 3, provided is a schematic view of an example probe which may be incorporated into a variety of suitable oven appliances, such as but not limited to the exemplary oven appliance of FIGS. 1 and 2. More specifically, provided in FIG. 3 is a schematic showing temperature probe 210 within combustion chamber 206. In particular, temperature probe 210 may be positioned proximate gas burner 126, such as within six inches (6 in), such as within four inches (4 in), such as within two inches (2 in). In other words, temperature probe 210 may be positioned within, or close to, a flame(s) 230, e.g., combustion products such as flames, heated gases, and other products, exiting gas burner 126. As may be seen in FIG. 3, temperature probe 210 may be a dual junction probe which includes a pair of temperature junctions 212, e.g., a first temperature junction 214 and a second temperature junction 216. Temperature probe 210 may include a probe sheath 220 to generally provide protection to internal components of the temperature probe 210 against flame(s) 230, and/or undesired contamination within oven appliance 100. For example, first temperature junction 214 and second temperature junction 216 may be positioned within and protected by probe sheath 220.

In the present example embodiment, first temperature junction 214 may be positioned at one end of the probe sheath 220 proximate gas burner 126, while second temperature junction 216 may be distal, or spaced away, from first temperature junction 214 and gas burner 126. Accordingly, a temperature difference between first temperature junction 214 and second temperature junction 216 may exist when flame(s) 230 is/are present in oven appliance 100. In particular, first temperature junction 214 and second temperature junction 216 may generally be connected by a first wire 218 of a first metal, such as iron, nickel, chromium, copper, or any combination thereof. In other words, first wire 218 may extend between first temperature junction 214 and second temperature junction 216 such that a circuit of temperature probe 210 to controller 140 is complete. In some example embodiments, temperature probe 210 may not include first wire 218, and sheath 220 may generally provide the connection between first temperature junction 214 and second temperature junction 216.

In general, temperature probe 210 may be configured to convert a difference in temperature measured between first temperature junction 214 and second temperature junction 216 and convert it to a voltage difference. In particular, the voltage difference measured by temperature probe 210 may be indicative of flame(s) 230 from gas burner 126. More specifically, the voltage difference measured by temperature probe 210 being indicative of flame(s) 230 from gas burner 126 may include reaching a threshold voltage, as will be explained further hereinbelow.

Figure 4:
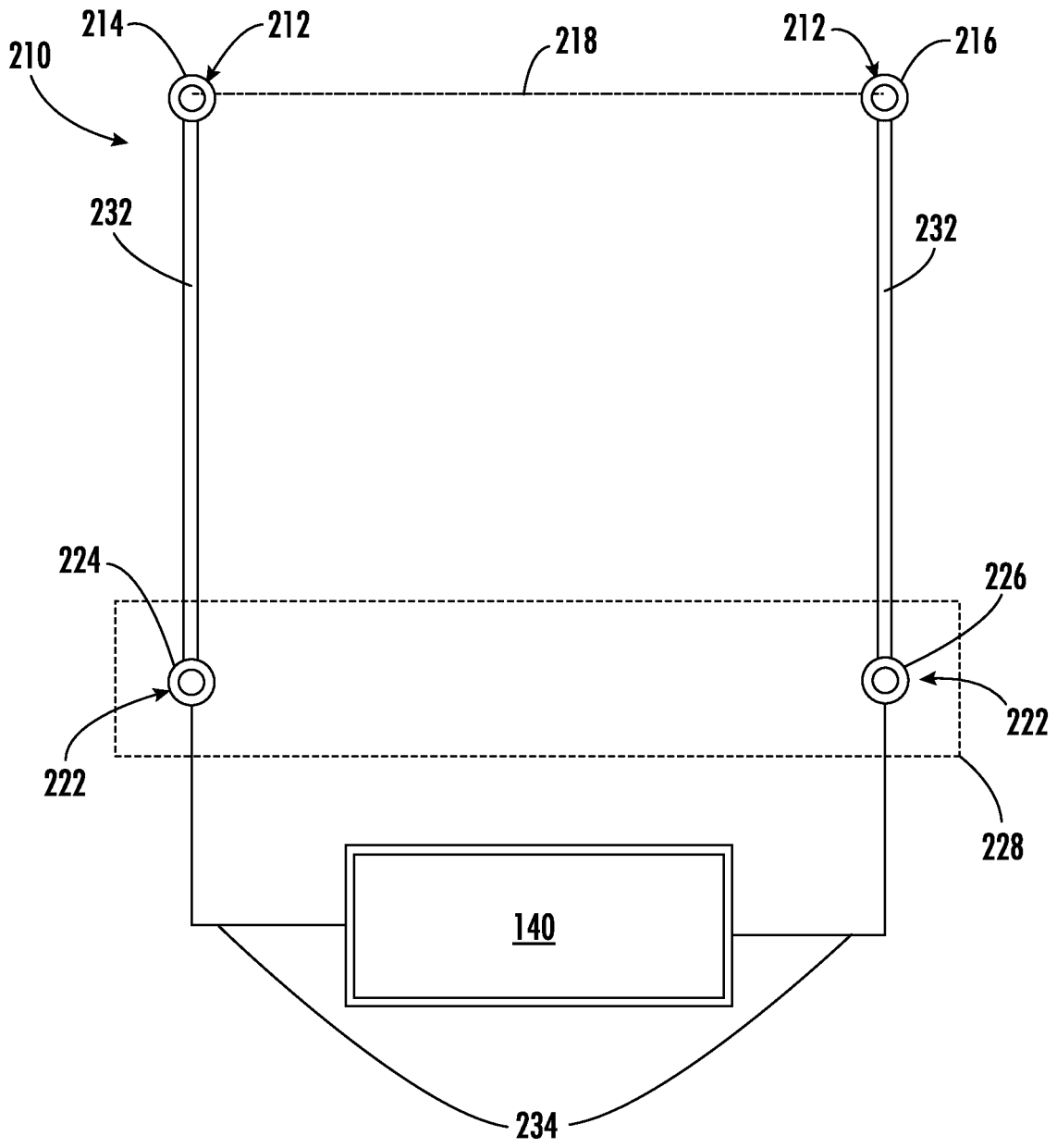
FIG. 4 provides a schematic view of an example electrical configuration of the probe of FIG. 3.

In another example embodiment, illustrated in FIG. 4, is a schematic view of an example electrical configuration of the probe of FIG. 3. As shown in FIG. 4, temperature probe 210 may further include a pair of voltage junctions 222, e.g., a first voltage junction 224 and a second voltage junction 226. In general, the pair of voltage junctions 222 may be positioned in an isothermal medium 228. Isothermal medium 228 may generally be an area either within cabinet 102 or outside of cabinet 102 where first voltage junction 224 and second voltage junction 226 may be about the same temperature. For example, inserting any type of wire into a thermocouple circuit, such as temperature probe 210, may have reduced effect on the output as long as both ends of the wire are the same temperature, or isothermal.

In the present example embodiment, the pair of voltage junctions 222 may each be connected to a respective temperature junction of the pair of temperature junctions 212 by a second wire 232 of a second metal, e.g., first wire 218 and second wire 232 may form the pair of temperature junctions 212. In other words, second wire 232 may extend between first temperature junction 214 to first voltage junction 224 and second temperature junction 216 to second voltage junction 226 such that each connection from temperature junction 214, 216 to voltage junction 224, 226 may have identical heat transfer/conductivity properties. Moreover, a third wire, or a single pair of wires 234, may extend between temperature probe 210 and controller 140, e.g., second wire 232 and respective wires of the single pair of wires 234 may form the pair of voltage junctions 222. More specifically, an individual wire of the single pair of wires 234 may extend from first voltage junction 224 to controller 140, and the other wire of the single pair of wires 234 may extend from second voltage junction 226 to controller 140. Additionally, each wire of the single pair of wires 234 may be an identical material to the other wire of the single pair of wires 234, as will be explained further hereinbelow. In other words, a circuit may couple temperature probe 210 and the controller 140, where the circuit consists of a single pair of wires 234 extending between temperature probe 210 and controller 140.

In general, controller 140 may be in data communication with temperature probe 210. In particular, temperature probe 210 may transmit temperature data and voltage data to controller 140. For example, the voltage difference from temperature probe 210, e.g., a positive difference in voltage from second voltage junction 224 to first voltage junction 222, may be indicative of flame(s) 230 from gas burner 126 being present in oven appliance 100 to controller 140. Furthermore, the voltage difference from temperature probe 210 being indicative of flame(s) 230 from gas burner 126 may include reaching a threshold voltage difference between first voltage junction 224 and second voltage junction 226. For example, the voltage threshold (with respect to direct current, DC) may be between one millivolt (1 mV) and twenty millivolts (20 mV), such as between one millivolt (1 mV) and ten millivolts (10 mv), such as between one millivolt (1 mV) and five millivolts (5 mV).

In other words, temperature probe 210 may sense flame(s) 230 from gas burner 126. Sensing flame(s) 230 may be accomplished using the voltage output of temperature probe 210 which will increase as the difference in temperature of the pair of temperature junctions 212 increases. For example, when the pair of temperature junctions 212 are the same temperature, the output of temperature probe 210 may be about zero volts (OV), but when either of the temperature junctions 214,216 is hotter, or cooler, than the other, a voltage may be introduced. The voltage is interpreted by controller 140, which evaluates the signal and determines if the voltage is enough, e.g., at or above a threshold value, to indicate a flame.

In general, regardless of an initial ambient temperature inside of the oven cavity in which the probe resides, the voltage signal may go up once there is a temperature differential between the two temperature junctions 214, 216. Additionally, a cold junction compensation may not be required for controller 140 as long as the single pair of wires 234 coming from temperature probe 210 are of the same material. Accordingly, standard low-cost wiring may be advantageously used to connect the temperature probe to controller 140, as long as the connection point for the pair of voltage junctions 222 to the single pair of wires 234 is isothermal.

As may be seen from the above, an oven appliance may include a gas burner system, wherein the oven appliance may include a dual-junction thermocouple provided inside the cabinet in order to detect a flame. The thermocouple probe may be arranged in such a manner that one of two temperature junctions remains close to the burner flame, whereas the other junction remains away from the flame. Additionally, the probe may include a single pair of distinct metal wires to communicate the state of burner to a controller. When the burner system is lit, i.e., flames may be present, a voltage may be induced in the probe (due to temperature difference between the two temperature junctions of the thermocouple) and this voltage may be interpreted by the controller to determine if there is a flame.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. An oven appliance, comprising:

a cabinet;

a chamber defined within the cabinet for receipt of food items for cooking, the chamber delineated by a plurality of walls including a bottom wall, a left side wall, and a right side wall;

a gas burner positioned within the chamber;

a dual junction temperature probe positioned proximate the gas burner, the dual junction probe comprising a pair of temperature junctions and a pair of voltage junctions; and a controller positioned within the cabinet, the controller in data communication with the temperature probe;

wherein the controller is configured for determining a flame is emanating from the gas burner based on a voltage difference measured by the temperature probe, wherein the pair of temperature junctions comprise a first wire comprising a first metal, and a second wire comprising a second metal different from the first metal, wherein the first wire extends between the pair of temperature junctions, and wherein the pair of voltage junctions each comprise a respective second wire extending from a respective temperature junction of the pair of temperature junctions and a third wire.

2. The oven appliance of claim 1, wherein the temperature probe is positioned within a probe sheath.

3. The oven appliance of claim 1, wherein the pair of voltage junctions are positioned in an isothermal medium.

4. The oven appliance of claim 1, wherein the controller is configured to determine the flame is emanating from the gas burner based on the voltage difference measured by the temperature probe reaching a threshold voltage.

5. The oven appliance of claim 1, further comprising a single pair of wires extending between the temperature probe and the controller.

6. The oven appliance of claim 5, wherein the single pair of wires consists of a first wire and a second wire, wherein the first wire comprises an identical material to the second wire.

7. The oven appliance of claim 1, further comprising a circuit coupling the temperature probe and the controller, wherein the circuit consists of a single pair of wires extending between the temperature probe and the controller.

8. An oven appliance, comprising:

a cabinet;

a chamber defined within the cabinet for receipt of food items for cooking;

a gas burner positioned in the cabinet;

a dual junction temperature probe positioned proximate the gas burner, the dual junction probe comprising a pair of temperature junctions and a pair of voltage junctions; and a controller positioned within the cabinet, the controller in data communication with the temperature probe;

wherein the controller is configured for detecting a flame at the gas burner based on a voltage difference measured by the temperature probe, wherein the pair of temperature junctions comprise a first wire comprising a first metal, and a second wire comprising a second metal different from the first metal, wherein the first wire extends between the pair of temperature junctions, and wherein the pair of voltage junctions each comprise a respective second wire extending from a respective temperature junction of the pair of temperature junctions and a third wire.

9. The oven appliance of claim 8, wherein the temperature probe is positioned within a probe sheath.

10. The oven appliance of claim 8, wherein the pair of voltage junctions are positioned in an isothermal medium.

11. The oven appliance of claim 8, wherein the voltage difference measured by the temperature probe being indicative of flames from the gas burner comprises reaching a threshold voltage.

12. The oven appliance of claim 8, further comprising a single pair of wires extending between the temperature probe and the controller.

13. The oven appliance of claim 12, wherein an individual wire of the single pair of wires comprises an identical material to the other wire of the single pair of wires.

14. The oven appliance of claim 8, further comprising a circuit coupling the temperature probe and the controller, wherein the circuit consists of a single pair of wires extending between the temperature probe and the controller.

15. An oven appliance, comprising:

a cabinet;

a chamber defined within the cabinet for receipt of food items for cooking, the chamber delineated by a plurality of walls including a bottom wall, a left side wall, and a right side wall;

a gas burner positioned within the chamber;

a dual junction temperature probe positioned proximate the gas burner, the dual junction probe comprising a pair of temperature junctions;

a controller positioned within the cabinet, the controller in data communication with the temperature probe; and a single pair of wires extending between the dual junction temperature probe and the controller the single pair of wires consists of a first wire and a second wire, wherein the first wire comprises an identical material to the second wire, and wherein the controller is configured for determining a flame is emanating from the gas burner based on a voltage difference measured by the temperature probe.

16. The oven appliance of claim 15, wherein the temperature probe is positioned within a probe sheath.

17. The oven appliance of claim 15, wherein the temperature probe further comprises a pair of voltage junctions.

18. The oven appliance of claim 17, wherein the pair of voltage junctions are positioned in an isothermal medium.

19. The oven appliance of claim 15, further comprising a circuit coupling the temperature probe and the controller, wherein the circuit consists of a single pair of wires extending between the temperature probe and the controller.

* * * * *